US011511172B2

(12) United States Patent
Goldman

(10) Patent No.: US 11,511,172 B2
(45) Date of Patent: Nov. 29, 2022

(54) PHYSICAL TRAINING APPARATUS AND METHOD FOR USING THE SAME

(71) Applicant: 9992316 Canada Inc., Dollard-Des Ormeaux (CA)

(72) Inventor: Joshua Goldman, Montréal (CA)

(73) Assignee: 9992316 Canada Inc., Quebec (CA)

( * ) Notice: Subject to any disclaimer, the term of this patent is extended or adjusted under 35 U.S.C. 154(b) by 416 days.

(21) Appl. No.: 16/722,922

(22) Filed: Dec. 20, 2019

(65) Prior Publication Data

US 2020/0197777 A1 Jun. 25, 2020

Related U.S. Application Data

(60) Provisional application No. 62/782,823, filed on Dec. 20, 2018.

(51) Int. Cl.
*A63B 69/20* (2006.01)
*A63B 71/02* (2006.01)

(52) U.S. Cl.
CPC ..... *A63B 69/201* (2013.01); *A63B 71/023* (2013.01)

(58) Field of Classification Search
CPC ... A63B 69/201; A63B 69/203; A63B 69/205; A63B 69/206; A63B 69/208; A63B 69/24; A63B 69/26; A63B 69/20–325
See application file for complete search history.

(56) References Cited

U.S. PATENT DOCUMENTS 2,653,816 A 9/1953 Young
5,221,243 A 6/1993 Walker
5,352,170 A 10/1994 Condo et al.
5,611,760 A * 3/1997 Jordan ..... A63C 19/005 482/93
6,994,348 B2 2/2006 Lambert et al.
(Continued)

FOREIGN PATENT DOCUMENTS

GB 2501730 A * 11/2013 ..... A63B 69/201
WO 1999033531 7/1999

OTHER PUBLICATIONS

Abs class .Dynamicsd. Siavash Dastvard. ABS workout "https://www.youtube.com/watch?v=sMh358B835E" Jan. 11, 2016 (Year: 2016).*

(Continued)

*Primary Examiner* — Nyca T Nguyen
(74) *Attorney, Agent, or Firm* — Wood, Phillips, Katz, Clark & Mortimer

(57) ABSTRACT

A physical training apparatus for use in striking training, the apparatus comprising: a frame having a perimeter member extending substantially along a perimeter member plane and a support assembly for supporting the perimeter member above a ground surface such that the perimeter member plane is substantially horizontal, the perimeter member surrounding a central space for receiving an instructor; and a plurality of striking targets suspended from the perimeter member, the striking targets being positioned around the central space to allow a user positioned radially outwardly from the frame, adjacent one of the striking targets and facing inwardly towards the central space, to interact with the striking target while maintaining visual contact with the instructor when the instructor is positioned in the central space.

16 Claims, 11 Drawing Sheets

(56) References Cited

U.S. PATENT DOCUMENTS

| | | | | |
|---|---|---|---|---|
| 7,458,919 | B2 | 12/2008 | Angelo | |
| D601,218 | S | 9/2009 | Forrest, Sr. | |
| 7,658,699 | B1 | 2/2010 | Johnson, Jr. | |
| D624,981 | S * | 10/2010 | Forrest, Sr. | D21/788 |
| D629,472 | S * | 12/2010 | Rhodes | D21/675 |
| D697,988 | S * | 1/2014 | Januszek | D21/826 |
| 8,876,616 | B2 | 11/2014 | Antuna | |
| 9,056,235 | B1 | 6/2015 | Mortland | |
| 9,889,363 | B1 | 2/2018 | Myrick | |
| 2002/0094917 | A1 * | 7/2002 | Wang | A63B 41/00 482/86 |
| 2002/0169054 | A1 * | 11/2002 | Schwendemann | A63B 69/201 482/86 |
| 2004/0214694 | A1 | 10/2004 | Borreca | |
| 2005/0227825 | A1 | 10/2005 | Kutov | |
| 2006/0100067 | A1 * | 5/2006 | Washburn | A63B 69/201 482/83 |
| 2006/0194675 | A1 * | 8/2006 | Valentine | A63B 69/201 482/83 |
| 2007/0167297 | A1 | 7/2007 | Stevenson | |
| 2008/0139367 | A1 * | 6/2008 | Cooper | A63B 69/004 482/83 |
| 2008/0227605 | A1 * | 9/2008 | Issak | A63B 69/0053 482/83 |
| 2009/0069123 | A1 | 3/2009 | Nugent | |
| 2010/0227743 | A1 * | 9/2010 | Jutte | A63B 21/16 482/142 |
| 2015/0273307 | A1 | 10/2015 | Vahid | |
| 2015/0290518 | A1 * | 10/2015 | Hudson | A63B 71/023 482/90 |
| 2015/0335932 | A1 * | 11/2015 | Chen | A63B 17/02 482/37 |
| 2016/0184684 | A1 * | 6/2016 | Ray | A63B 69/004 482/89 |
| 2018/0015328 | A1 | 1/2018 | Fradin | |
| 2019/0316370 | A1 * | 10/2019 | Drakulich | A63B 24/0075 |

OTHER PUBLICATIONS

Smai, 14 Station Bag Rack Pack, publicly available at least as early as Dec. 6, 2018 from https://www.smai.com.au/products/14-station-bag-rack-pack?variant=17017376385.

Zoobgear, Heavy Duty Multiple Heavy Bags Stand, publicly available at least as early as Dec. 6, 2018 from: https://www.zoobgear.com/products/title-heavy-duty-multiple-heavy-bags-stand.

* cited by examiner

PHYSICAL TRAINING APPARATUS AND METHOD FOR USING THE SAME

CROSS-REFERENCE TO RELATED APPLICATIONS

The present claims priority from U.S. Provisional Patent Application No. 62/782,823 filed on Dec. 20, 2018, the specification of which is incorporated herein by reference.

TECHNICAL FIELD

The technical field relates to physical training apparatuses, and more specifically to physical training apparatuses for striking training and to method.

BACKGROUND

Physical training may involve a series of separate types of training which can be performed for general fitness or to improve certain skills in some sports or activities.

In particular, striking training involves the use of hands, feet or other body parts to strike an object, commonly a punching bag, or another type of target. Striking training could be part of a global fitness training routine or of specialized training for certain sports and activities such as boxing, martial arts or the like.

In some instances, striking training could be conducted in a group training session, where multiple participants or trainees follow the instructions of a single instructor.

Some rigs or apparatuses including punching bags are currently available. Unfortunately, existing apparatuses may not be configured to allow every participant in the group training sessions to properly maintain visual contact with the instructor or to have enough personal space to properly perform the movements required in the training session.

SUMMARY

According to one aspect, there is provided a physical training apparatus for use in striking training, the apparatus comprising: a frame having a perimeter member extending substantially along a perimeter member plane and a support assembly for supporting the perimeter member above a ground surface such that the perimeter member plane is substantially horizontal, the perimeter member surrounding a central space for receiving an instructor; and a plurality of striking targets suspended from the perimeter member, the striking targets being positioned around the central space to allow a user positioned radially outwardly from the frame, adjacent one of the striking targets and facing inwardly towards the central space, to interact with the striking target while maintaining visual contact with the instructor when the instructor is positioned in the central space.

In at least one embodiment, each striking target includes a punching bag.

In at least one embodiment, the perimeter member forms a closed loop.

In at least one embodiment, the perimeter member includes a plurality of horizontal frame members connected end-to-end to each other.

In at least one embodiment, all the horizontal frame members have a same length.

In at least one embodiment, the plurality of striking targets includes a plurality of pairs of striking targets, each pair of striking targets being suspended from a corresponding horizontal frame member.

In at least one embodiment, the plurality of horizontal frame members includes eight horizontal frame members defining an octagonal loop.

In at least one embodiment, the plurality of horizontal frame members includes four horizontal frame members defining a square loop.

In at least one embodiment, each striking target is offset laterally relative to a longitudinal axis of a corresponding horizontal frame member.

In at least one embodiment, each striking target is supported by a support bracket extending laterally away from the corresponding horizontal frame member.

In at least one embodiment, the support bracket includes a cantilevered beam member extending horizontally between a proximal end secured to the support bracket and a distal end configured for holding the striking target.

In one embodiment, the support bracket further includes an eye bolt extending downwardly from the distal end of the cantilevered beam member for attaching a link member extending upwardly from the striking target.

In one embodiment, the cantilevered beam member is perpendicular to the corresponding horizontal frame member, In one embodiment, the support bracket further includes: a bracket bar spaced downwardly from the corresponding horizontal frame member and extending parallel thereto; and a diagonal brace member having a lower end secured to the bracket bar and an upper end secured to the distal end of the cantilevered beam member.

In at least one embodiment, all the striking targets suspended from a same horizontal frame member are offset from the horizontal frame member in one of an inward direction towards the central space and an outward direction away from the central space.

In at least one embodiment, all the striking targets suspended from a first horizontal frame member are offset in one of the inward and outward directions and all the striking targets suspended from a second horizontal frame member adjacent the first horizontal frame member are offset in the other one of the inward and outward directions such that the striking targets are offset alternatingly in the inward direction and the outward direction between adjacent horizontal frame members.

In at least one embodiment, the support assembly includes a plurality of vertical posts having a lower end for resting on a ground surface and an upper end secured to the frame.

In at least one embodiment, the support assembly includes a plurality of suspension members extending downwardly from a ceiling surface, each suspension member having an upper end secured to the ceiling surface and a lower end secured to the frame.

In at least one embodiment, each striking target is further tethered to the ground surface below the striking target.

According to another aspect, there is also provided a method for using a physical training apparatus for striking training, the method comprising: providing a training apparatus including: a frame having a perimeter member and a support assembly for supporting the perimeter member above a ground surface, the perimeter member surrounding a central space adapted to receive an instructor; and a plurality of striking targets suspended from the perimeter member; positioning an instructor in the central space; and positioning a plurality of users around the frame, radially outwardly from the central space, each user being positioned adjacent one of the striking targets and facing inwardly towards the central space to allow the user to interact with the striking target while maintaining visual contact with the instructor.

According to yet another aspect, there is also provided a physical training apparatus for use in striking training, the apparatus comprising: a target support; a plurality of striking targets secured to the target support, the target support maintaining the striking targets in an operative configuration in which each striking target is strikable by a user located adjacent the striking target, the striking target being disposed annularly on the target support to define a central space therebetween, the striking targets being positioned around the central space to allow a user positioned radially outwardly from the central space, adjacent one of the striking targets and facing inwardly towards the central space, to interact with the striking target while maintaining visual contact with an instructor positioned in the central space.

DETAILED DESCRIPTION

Figure 1:
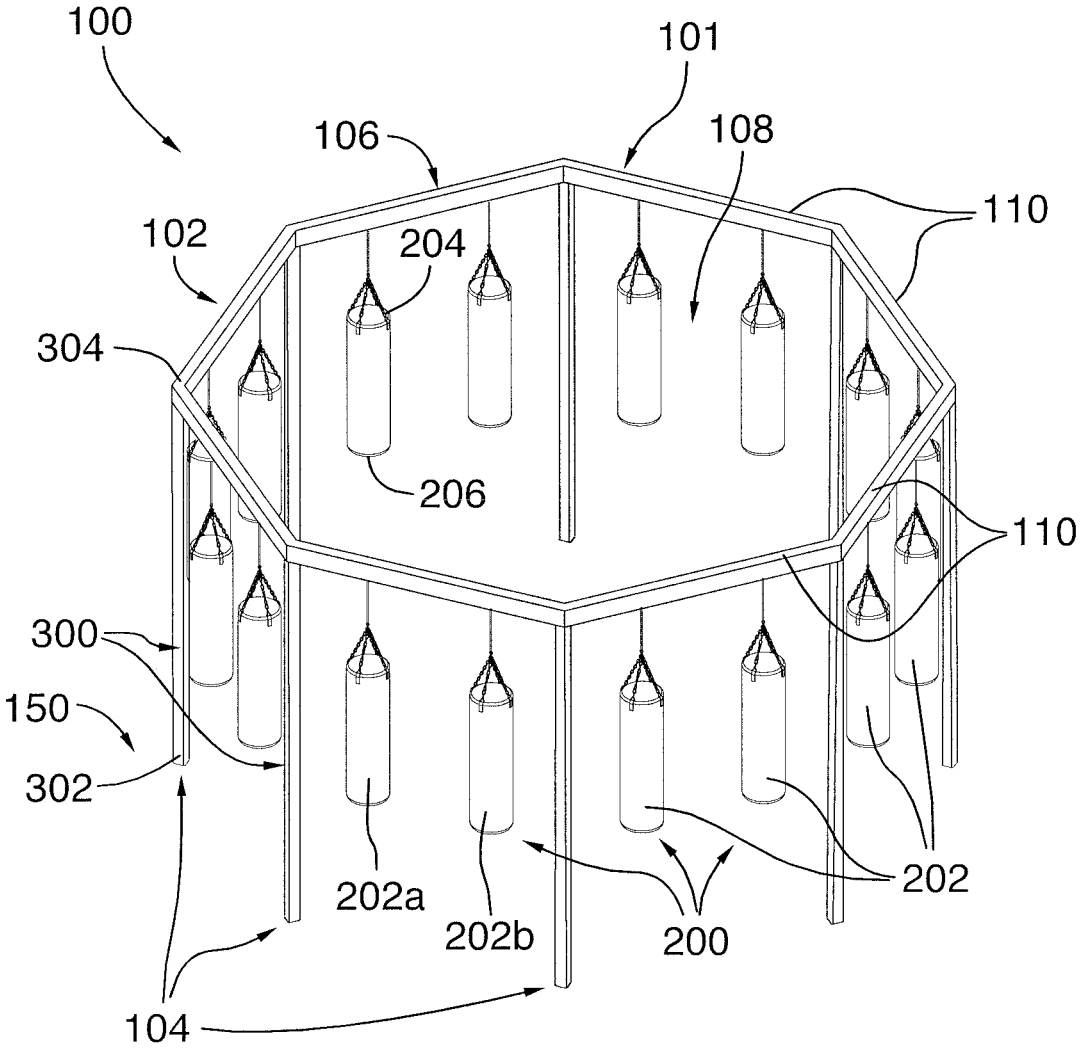
FIG. 1 is a schematic drawing showing a top perspective view of a physical training apparatus, in accordance with one embodiment, in which the apparatus includes a frame supported horizontally by a supporting assembly including a plurality of vertical posts.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Figure 2:
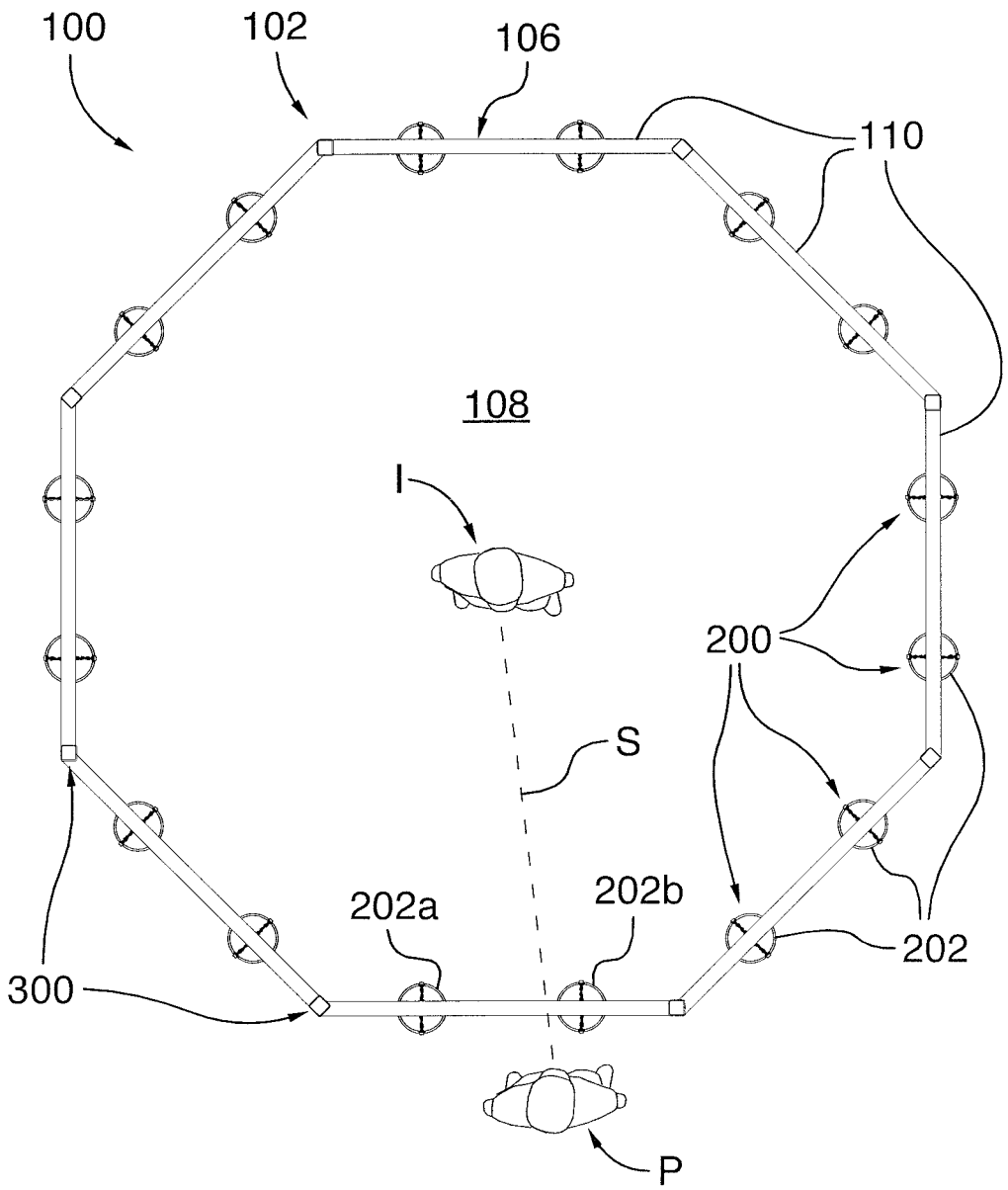
FIG. 2 is a schematic drawing showing a top plan view of the physical training apparatus illustrated in FIG. 1, with an instructor I located in the central space of the apparatus and one of the participants P provided as an example and located near a punching bag and having a clear line of sight S to the instructor I.

Referring first to FIGS. 1 and 2, there is provided a physical training rig or apparatus 100 for use in striking training, in accordance with one embodiment. In the illustrated embodiment, the training apparatus 100 includes a target support 101 and a plurality of striking targets 200 connected to the target support 101. Specifically, the target support 101 to maintain the striking targets 200 in an operative configuration in which each striking target 200 is strikable by a user located adjacent the striking target 200. For example, in the illustrated embodiment, the striking targets 200 include generally cylindrical and elongated punching bags 202 which are in an operative configuration when positioned such that they extend generally vertically. In this embodiment, the target support 101 includes a frame 102 and a support assembly 104 supporting the frame 102 horizontally above a ground or floor surface 150, and the plurality of striking targets 200 are suspended from the frame 102. More specifically, each punching bag 202 has an upper end 204 and an opposed lower end 206. The punching bag 202 is suspended by its upper end 204, while its lower end 206 is free. It will be understood that in this arrangement, gravity causes the punching bags 202 to be maintained in the operative configuration, i.e. substantially vertical, such that they can be used for striking training.

In the illustrated embodiment, the frame 102 includes a perimeter member 106 which surrounds a central space 108. Still in the illustrated embodiment, the perimeter member 106 extends in a perimeter member plane which, when the perimeter member 106 is supported by the support assembly 104, extends generally parallel to the floor surface 150.

It will be understood that while FIG. 2 shows only a single participant P as an example, during a striking training group session, a plurality of participants P would be positioned outwardly from the perimeter member 106, in front of a respective striking target 200. During the striking training group session, an instructor I may stand in the central space 108. The configuration of the apparatus 100 allows the plurality of users or participants P positioned outwardly from the perimeter member 106 facing towards the central space 108 to interact with the striking target 200 while being able to maintain visual contact with the instructor I in the central space 108. More specifically and as shown in FIG. 2, each participant P can have a clear line of sight S to the instructor I during the striking training group session.

In conventional striking training group session, the participants are often positioned in rows and face in the same direction, thereby forming a generally square formation. This may cause some participants to develop a slightly claustrophobic feeling, especially for the participants positioned away from the edges of the square formation. In contrast, since the apparatus 100 includes the central space 108 and since the participants P are positioned outside of the central space 108 during the training session, the present configuration further may further contribute to eliminating this claustrophobic feeling.

Furthermore, since the participants P are facing inwardly towards the central space 108 during a striking training group session, the participants P are also generally facing towards each other, which may bring a sense of community and teamwork to the participants P. This configuration also allows the instructor to have direct access to all participants P by pivoting around during the striking training group session while remaining in the central space 108. This may allow the instructor I to provide specific encouragements or instructions to one of the participants P as needed.

In one embodiment, the punching bags 202 may be made of a shock-absorbing material and/or with a shock-absorbing internal configuration which may contribute to reducing the risk of injuries related to striking training and which may be particularly well-adapted for novice participants with relatively little experience in striking training. Alternatively, the striking targets 200 may include any other type of targets that can be used for striking training.

In the illustrated embodiment, the perimeter member 106 includes a plurality of horizontal frame members 110 which are secured to each other end-to-end to define a closed loop. Alternatively, the perimeter member 106 may not form a completely closed loop and may instead be substantially penannular, U-shaped or have any other suitable shape.

Still in the illustrated embodiment, the horizontal frame members 110 are linear and are all of a same length such that the perimeter member 106 defines a regular polygon. Alternatively, the horizontal frame members 110 could be curved and/or have different length to form a perimeter member having a different configuration.

In the illustrated embodiment, the plurality of horizontal frame members 110 include eight (8) horizontal frame members 110 forming an octagonal frame. Still in the illustrated embodiment, the punching bags 202 include sixteen (16) punching bags which are divided into eight (8) pairs of punching bags 202*a*, 202*b*. The punching bags 202 are disposed such that each pair of punching bags 202*a*, 202*b* are suspended from a corresponding horizontal frame member 110, as shown in FIGS. 1 and 2. This configuration may offer a number of advantages. Each participant participating to the striking training group session using the apparatus 100 will be able to be positioned next to a partner or friend. Participants with special needs may further advantageously be positioned next to their attendant or "shadow", which may bring comfort to the participant.

Alternatively, the punching bags 202 may not be provided in pairs of punching bags 202*a*, 202*b*. For example, the punching bags 202 may instead be disposed such that a single one of the punching bags 202 is suspended from each horizontal frame member 110. In another embodiment, the punching bags 202 may be disposed such that more than two of the punching bags 202 is suspended from each horizontal frame member 110. In yet another embodiment, the punching bags 202 may instead be disposed on the frame 102 according to one of various other configurations.

In the illustrated embodiment, the support assembly 104 includes a plurality of vertical posts 300 which hold up the frame 102 above the floor surface 150. Specifically, each vertical post 300 includes a lower end 302 which rests on the floor surface 150 and an upper end 304 opposite the lower end 302. In this embodiment, the horizontal frame members 110 extend between the upper ends 302 of the vertical posts 300. As shown in FIG. 1, the vertical posts 300 all have generally the same length such that when the frame 102 is secured to the upper ends 302 of the vertical posts 300, the frame 102 extends generally horizontally in the perimeter member plane and parallel to the floor surface 150.

In one embodiment, the lower end 304 of each vertical post 300 is inserted into the floor surface 150 to prevent the apparatus 100 from moving relative to the floor surface during striking training. Alternatively, each vertical post 300 could instead include a base secured to the lower end 304 of the post 300. The base could be adapted to be secured to the floor surface 150, for example using bolts or similar fasteners to prevent movement of the vertical post 300.

Figure 3:
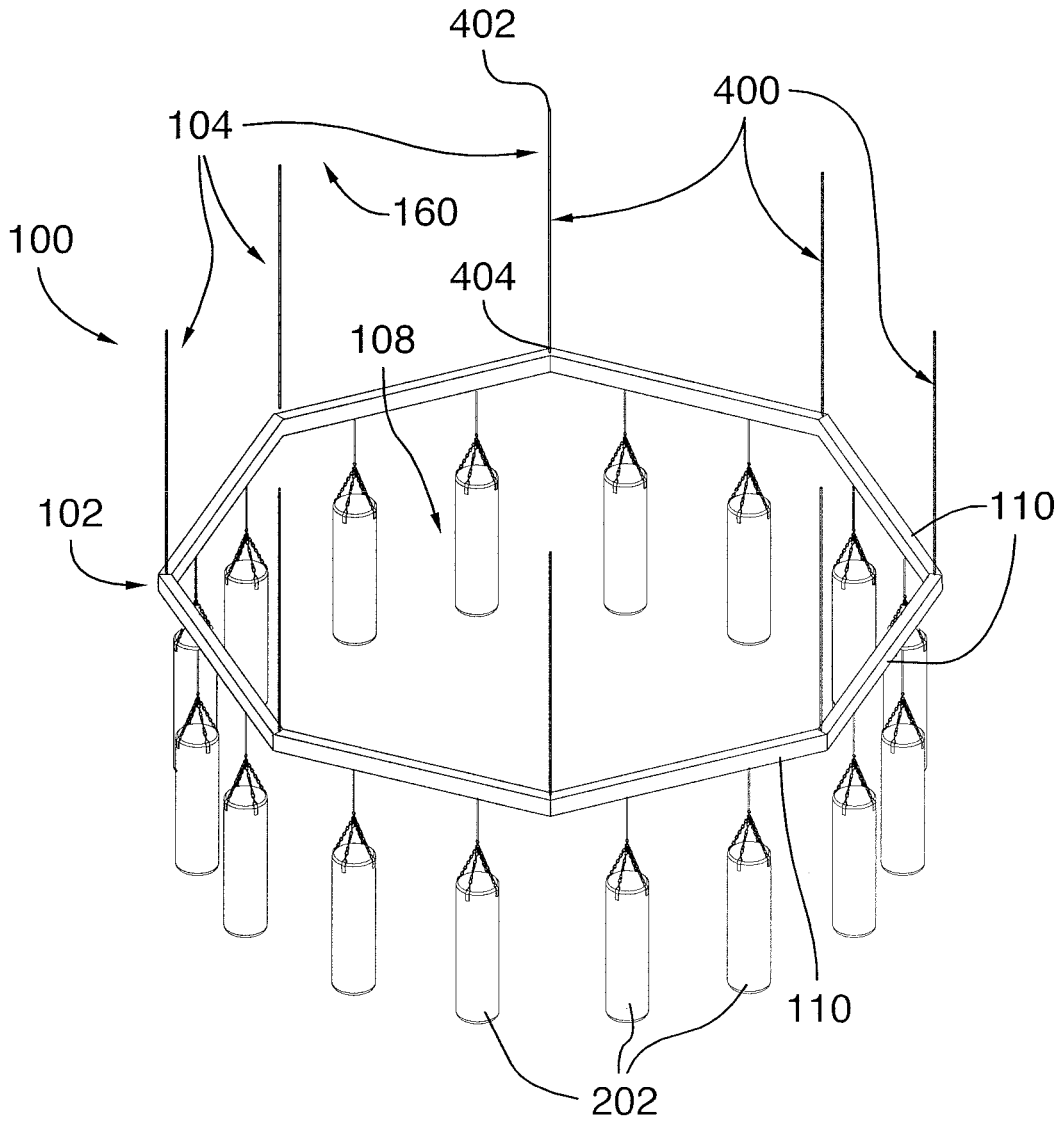
FIG. 3 is a schematic drawing showing a top perspective view of a physical training apparatus, in accordance with another embodiment, in which the supporting assembly including a plurality of suspension members extending downwardly from a ceiling.

FIG. 3 shows another embodiment of the apparatus 100, in which the support assembly 104 does not include vertical posts 300, but instead includes a plurality of suspension members 400 which extend downwardly from a ceiling surface 160. More specifically, each suspension member 400 has an upper end 402 secured to the ceiling surface 160 and a lower end 404, and the frame 102 is secured to the lower end 404 of the suspension members 400. In the illustrated is embodiment, all the suspension members 400 have generally the same length, such that the frame 102, when suspended from the ceiling surface 160, extends generally horizontally and parallel to the ceiling surface 160. In one embodiment, the suspension members 400 could include chains, cables, rods or any other suitable suspension member.

Figure 4A:
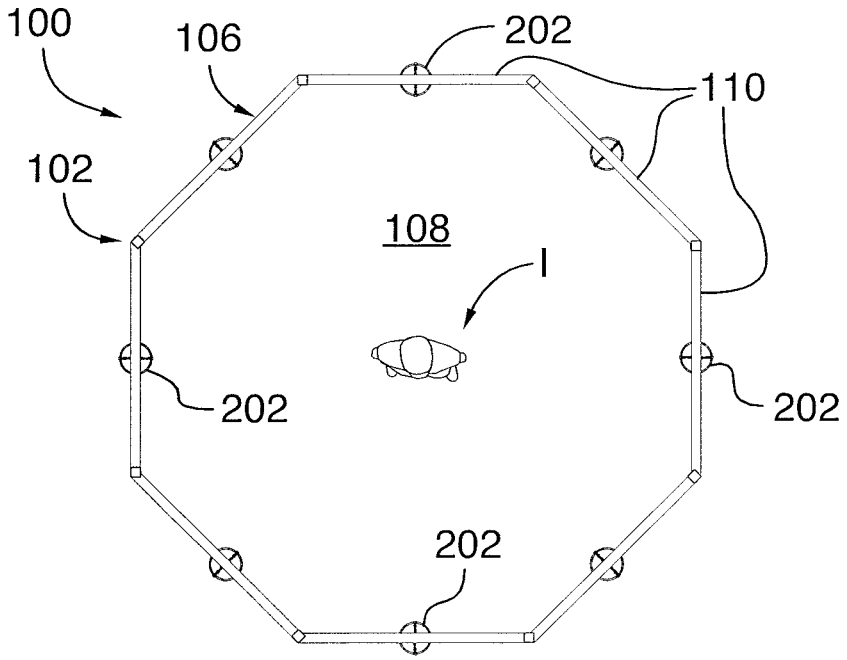
FIG. 4A is a schematic drawing showing a top plan view of a physical training apparatus, in accordance with another embodiment, in which the frame is octagonal and punching bags are suspended from the frame such that a single punching bag is suspended from each frame member of the frame.

FIG. 4A shows another embodiment of the apparatus 100, in which the frame 102 still includes eight (8) horizontal frame members 110 defining an octagonal loop, but in which the plurality of punching bags 202 includes only eight (8) punching bags 202, which each punching bag 202 being suspended from a corresponding one of the horizontal frame members 110 instead of the punching bags 202 being suspended in pairs from each horizontal frame member 110. Alternatively, more than one punching bags 202 could be suspended from each horizontal frame member 110.

Figure 4B:
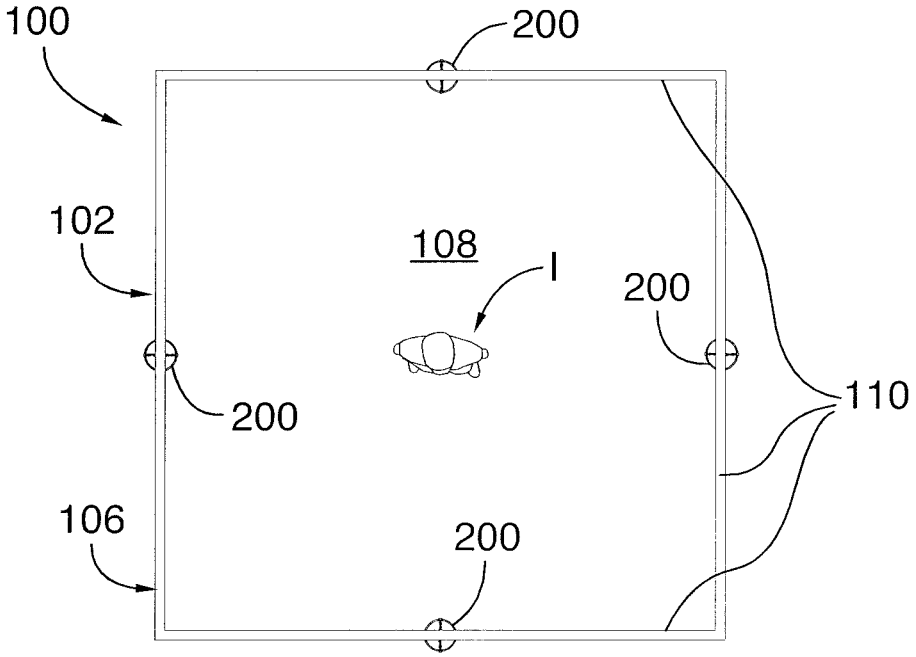
FIG. 4B is a schematic drawing showing a top plan view of a physical training apparatus, in accordance with yet another embodiment, in which the frame is square and in which a single punching bag is suspended from each frame member.

FIG. 4B shows another embodiment of the apparatus 100, in which the frame 102 includes four (4) horizontal frame members 110 disposed generally at 90-degree angles to each other to thereby define a rectangular loop. In the embodiment illustrated in FIG. 4B, the horizontal frame members 110 all have generally the same length and thereby define a square loop. Still in the embodiment illustrated in FIG. 4B, the plurality of punching bags 202 includes only four (4) punching bags 202, which each punching bag 202 being suspended from a corresponding one of the horizontal frame members 110. Alternatively, more than one punching bags 202 could be suspended from each horizontal frame member 110.

Figure 4C:
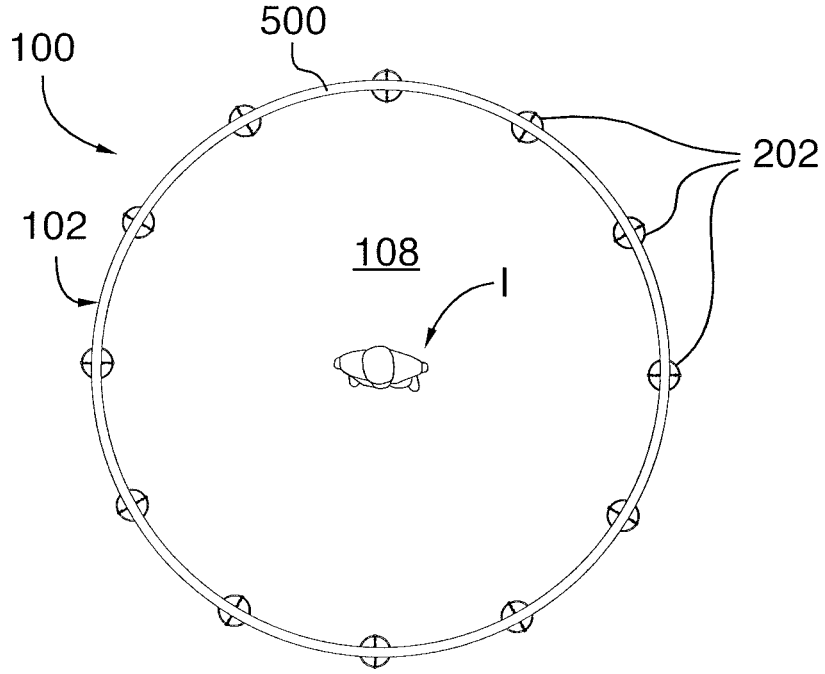
FIG. 4C is a schematic drawing showing a top plan view of a physical training apparatus, in accordance with still another embodiment, in which the frame is circular and in which the punching bags are suspended from the frame and are generally evenly spaced from each other.

FIG. 4C shows another embodiment of the apparatus 100, in which the frame 102 does not include a plurality of horizontal frame members 110, but instead includes a single circular member 500 defining the perimeter member 106. In the embodiment illustrated in FIG. 4C, the punching bags 202 are suspended from the circular member 500 and are generally spaced evenly from each other around the central space 108.

Figure 4D:
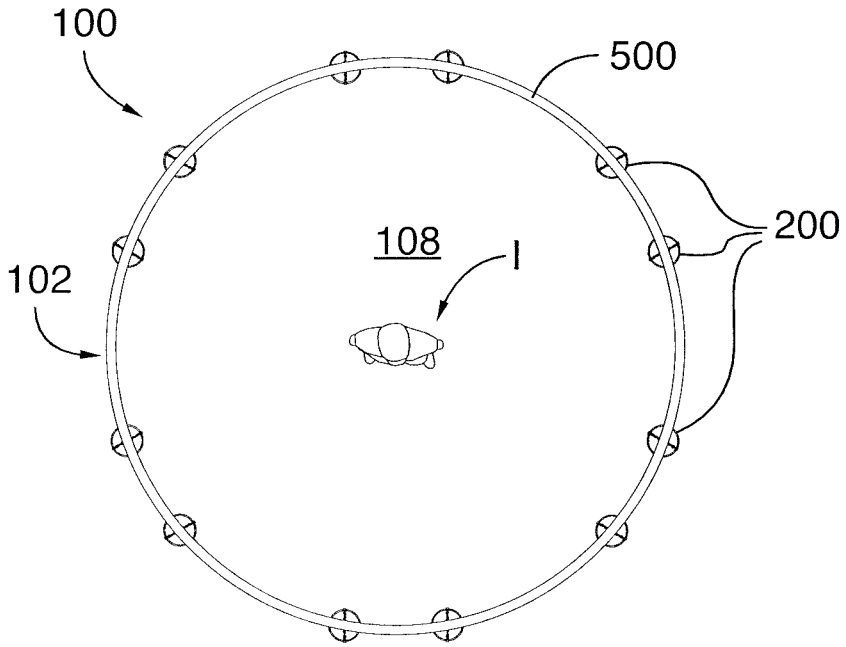
FIG. 4D is a schematic drawing showing a top plan view of a physical training apparatus, in accordance with yet still another embodiment, in which the frame is circular and in which the punching bags are suspended from the frame and are generally evenly spaced from each other.

FIG. 4D shows yet another embodiment of the apparatus 100, which is generally similar to the embodiment illustrated in FIG. 4C, except that the punching bags 202 are grouped in a plurality of pairs of punching bags 202*a*, 202*b*, similarly to the embodiment illustrated in FIGS. 1 and 2.

It will be understood that that the configurations illustrated in FIGS. 4A to 4D are merely shown as examples and that the frame 102 could have any number of horizontal frame members 110 and any shape, including open shapes or closed shapes, which would define the central space 108.

Figure 5A:
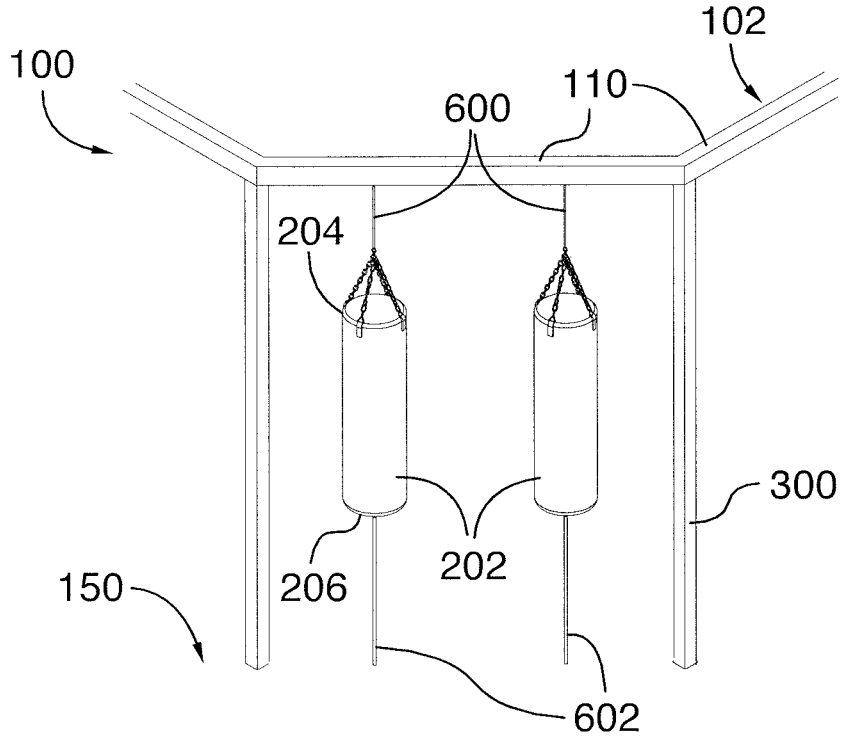
FIG. 5A is a schematic drawing showing an enlarged portion of a physical training apparatus, in accordance with one embodiment, in which the punching bags are tethered to the ground surface.

Now referring to FIG. 5A, in one embodiment, the punching bags 202 could further be tethered to the floor surface 150. Specifically, the upper end 204 of each punching bag 202 may be attached to the corresponding horizontal frame member 110 using a link member 600, which could include a chain, a cable or any other suitable link member. In the embodiment illustrated in FIG. 5A, each punching bag 202 is further attached to the floor surface 150 using a tether member 602 extending from the lower end 206 of the punching bag 202 to the floor surface 150. This configuration may improve the stability of the punching bag 202 and reduce undesirably large swinging movements of the punching bag 202 during striking training.

Figure 5B:
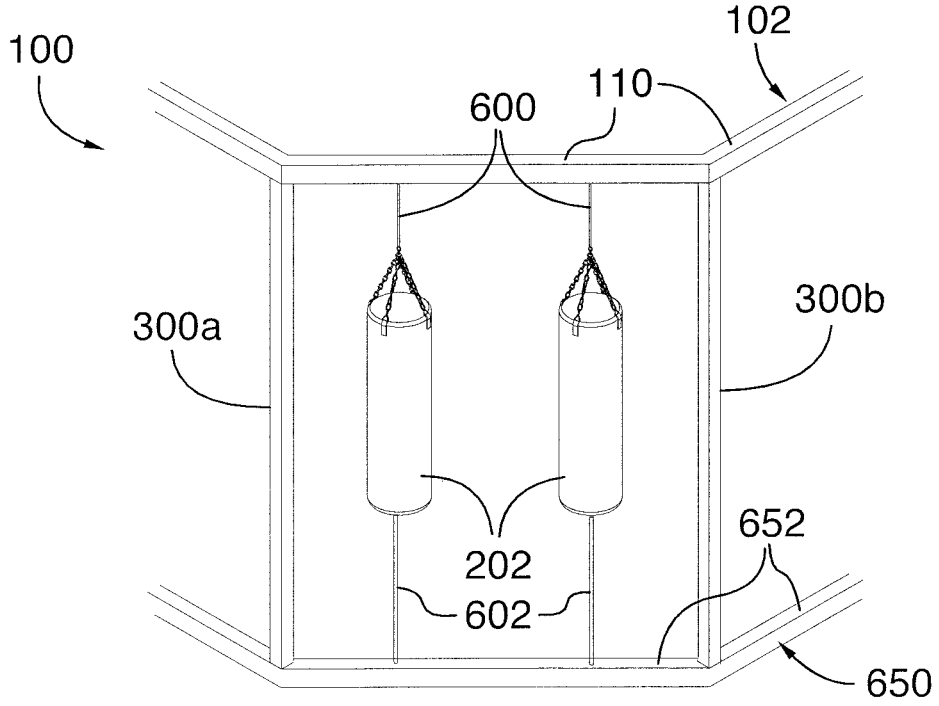
FIG. 5B is a schematic drawing showing an enlarged portion of a physical training apparatus, in accordance with another embodiment, in which the punching bags are tethered to a lower frame received on the ground surface.
Figure 6:
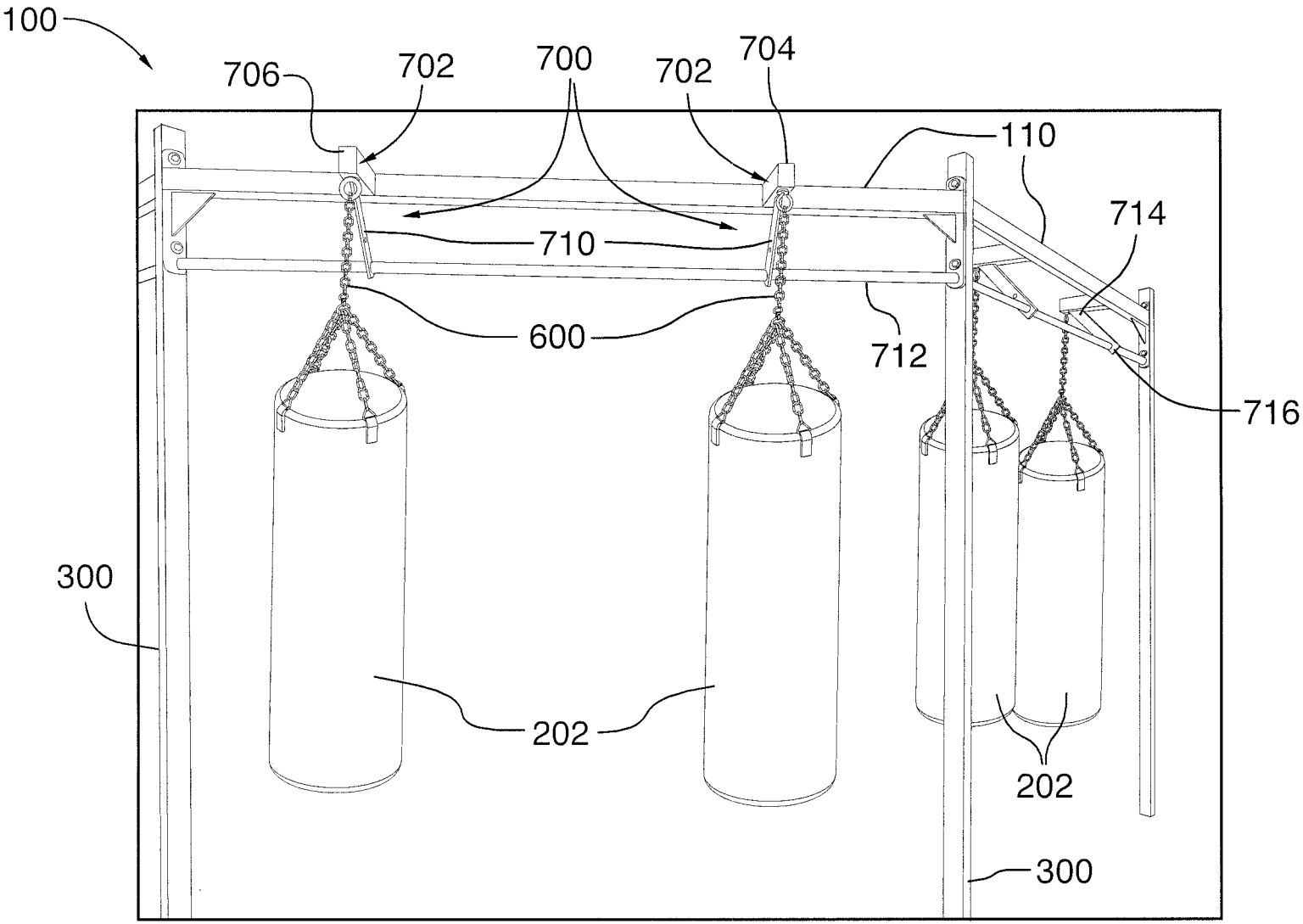
FIG. 6 is a schematic drawing showing an enlarged portion of a top perspective view of a physical training apparatus, in accordance with yet another embodiment, in which the punching bags are offset from the corresponding horizontal frame member and are disposed in an alternating pattern inwardly and outwardly from the frame.

FIG. 5B shows another embodiment of the apparatus 100 in which the punching bags 202 are tethered, similarly to the embodiment illustrated in FIG. 5A. In this embodiment, the apparatus 100 further includes a base frame 650 which is generally similar to the frame 102, but which is connected to the lower ends 304 of the vertical posts 300 and is therefore spaced vertically below the frame 102. In this embodiment, each base frame member 652 extends between the lower ends 304 of adjacent vertical posts 300*a*, 300*b*, along the floor surface 150 and parallel to the corresponding horizontal frame member 110. In this embodiment, the tether member 602 extends from the lower end 206 of the punching bag 202 to the corresponding base member 652.

Figure 7:
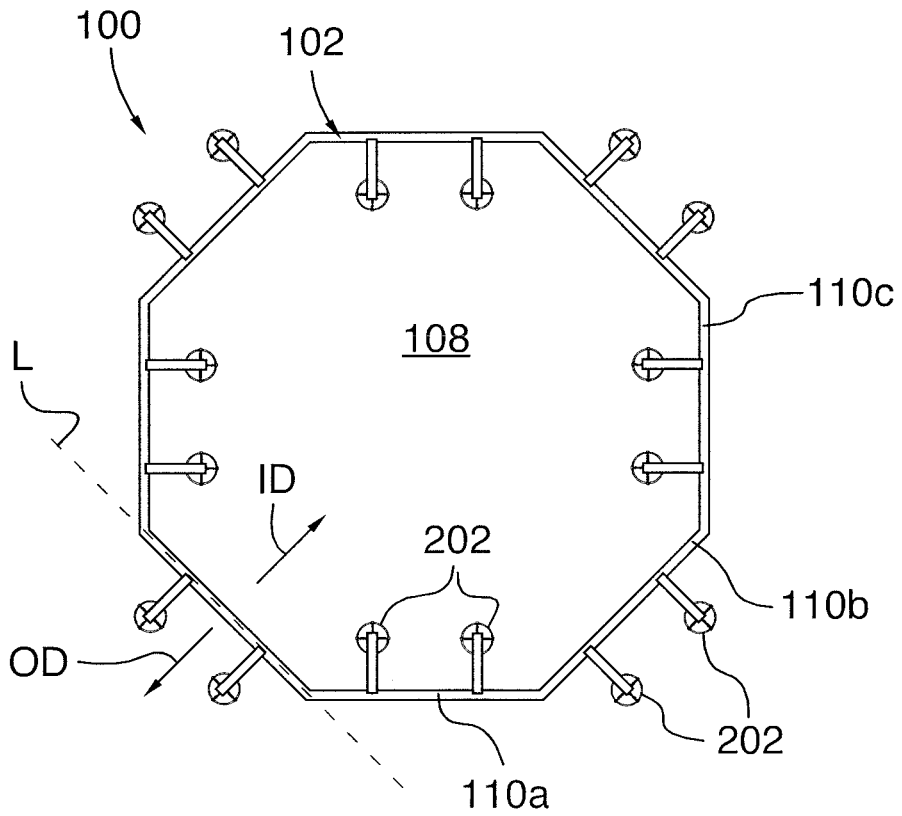
FIG. 7 is a top plan view of the physical training apparatus illustrated in FIG. 6, showing the punching bags being disposed in an alternating pattern inwardly and outwardly from the frame.

Now turning to FIGS. 6 to 10, there is provided the apparatus 100 in accordance with another embodiment. In this embodiment, instead of being suspended directly from the horizontal frame members 110 of the frame 102, the punching bags 202 are instead offset laterally relative to a longitudinal axis L of a corresponding horizontal frame member 110, as best shown in FIG. 7. More specifically, the punching bags 202 are still suspended from the horizontal frame members 110, but instead of being connected directly to the horizontal frame member 110, the punching bags 202 are suspended from a support bracket 700 extending laterally away from the corresponding horizontal frame member 110.

In the illustrated embodiment, each support bracket 700 includes a cantilevered beam member 702 which extends generally laterally away from the corresponding horizontal frame member 110. More specifically, each cantilevered beam member 702 includes a proximal end 704 secured to the corresponding horizontal frame member 110 and a distal end 706 located away from the corresponding horizontal frame member 110. The distal end 706 is adapted for attaching the punching bag 202 to the cantilevered beam member 702. More specifically, the support bracket 700 includes an eye bolt 708 which extends downwardly from the distal end 706 of the cantilevered beam member 702. The eye bolt 708 is adapted for receiving the link member 600 extending upwardly from the punching bag 202 to thereby attach the punching bag 202 to the support bracket 700.

Figure 8:
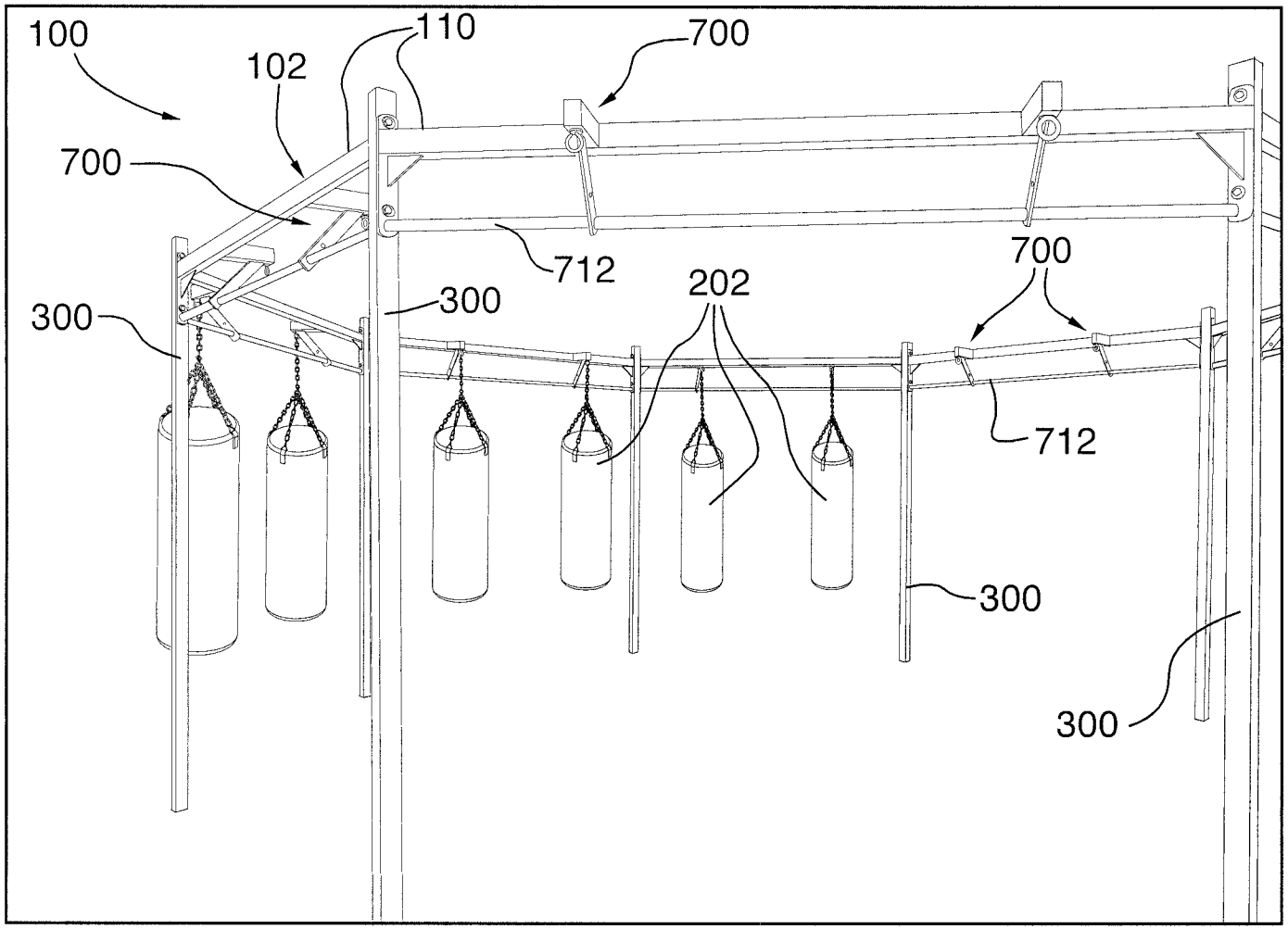
FIG. 8 is a perspective view of a portion of the physical training apparatus illustrated in FIG. 6, with punching bags provided only on some of the support brackets.
Figure 9:
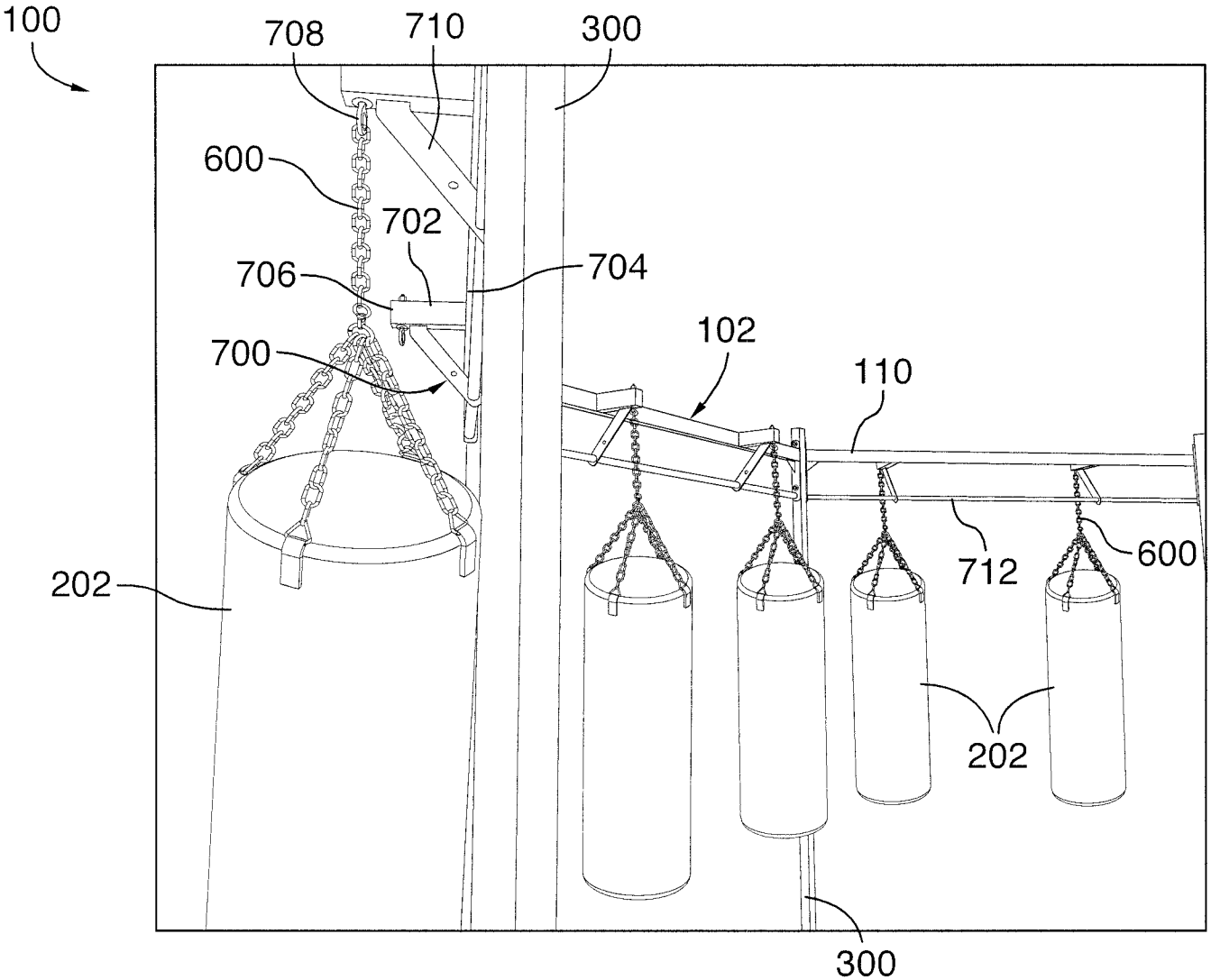
FIG. 9 is another perspective view of a portion of the physical training apparatus illustrated in FIG. 6.
Figure 10:
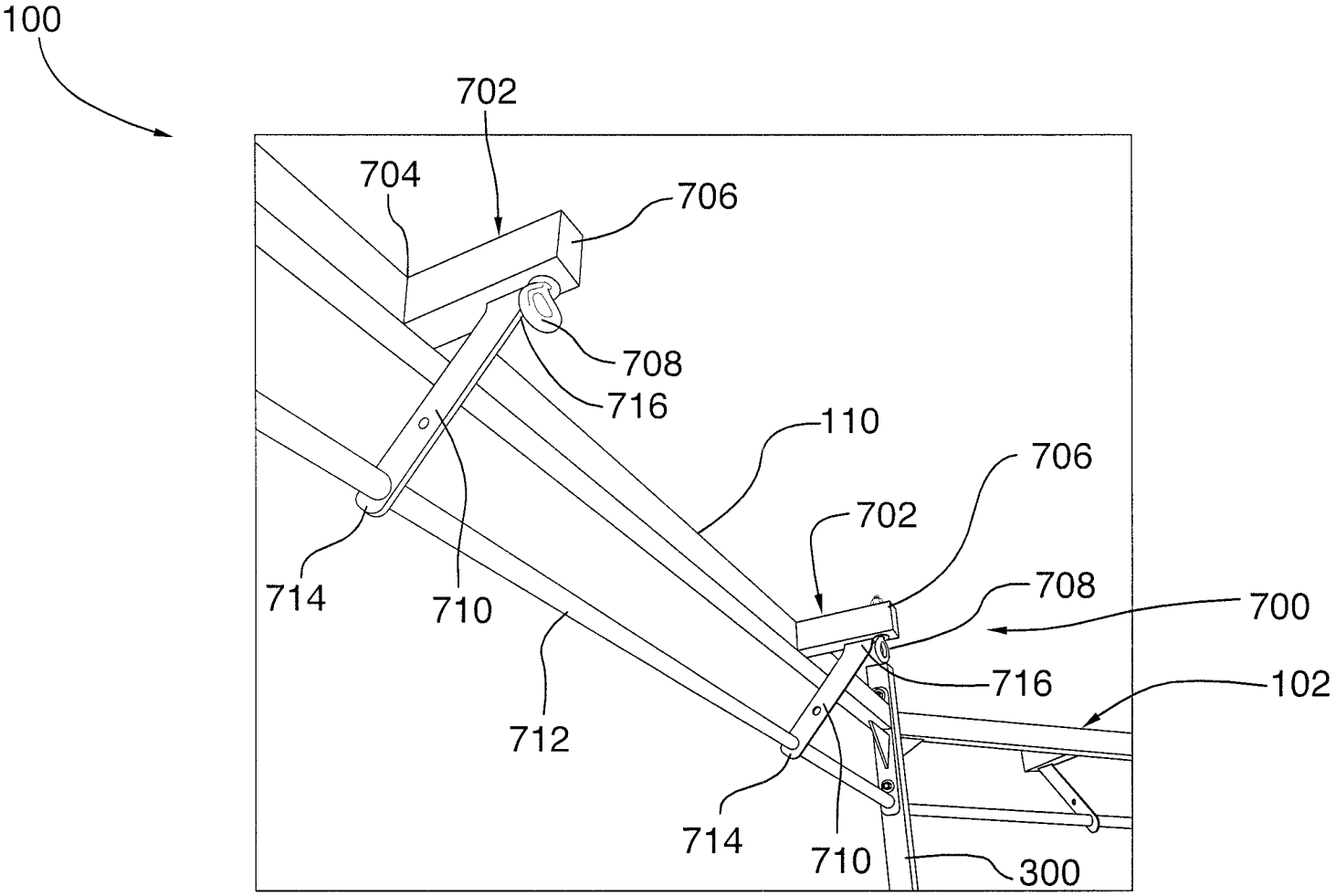
FIG. 10 is another enlarged view of the physical training apparatus illustrated in FIG. 8, with the punching bags removed to show details of the support brackets.

As best shown in FIG. 10, each support bracket 700 further includes a diagonal brace member 710 which extend below the cantilevered beam member 702 to support the cantilevered beam member 702 and maintain the cantilevered beam member 702 in a horizontal orientation. In the illustrated embodiment, the apparatus 100 includes a bracket bar 712 which is spaced downwardly from the corresponding horizontal frame member 110. More specifically, the bracket bar 712 extends generally parallel to the corresponding horizontal frame member 110 between adjacent vertical posts 300. As shown in FIGS. 8 to 10, the diagonal brace member 710 extends between the bracket bar 712 and the cantilevered beam member 702. More specifically, the diagonal brace member 710 includes a lower end 714 secured to the bracket bar 712 and an upper end 716 secured to the distal end 706 of the cantilevered beam member 702. This define a triangular configuration which is particularly well-adapted to support the weight of the punching bag 202 exerting a downward force at the distal end 706 of the cantilevered beam member 702.

In another embodiment, instead of each support bracket 700 supporting a single punching bag 202, each support bracket 700 could instead be configured to support two or more punching bags 202. Alternatively, the support brackets 700 may be configured according to any other suitable configuration.

Since the punching bags 202 are laterally offset from the horizontal frame members 110, it will be understood that the punching bags 202 may be laterally offset in one of an inward direction ID towards the central space 118 and an outward direction OD away from the central space 118, as shown in FIG. 7.

In the embodiment illustrated in FIGS. 6 to 10, all the punching bags 202 suspended from a corresponding horizontal frame member 110 are offset in the same direction, whether the inward direction ID or the outward direction OD. Furthermore, the punching bags 202 are disposed such that they are offset alternatingly in the inward direction ID and in the outward direction OD from the frame 102 from one frame member 110 to the next adjacent frame member 110. For example, in the illustrated embodiment, both punching bags 202 suspended from a first horizontal frame member 110*a* are offset in the inward direction ID, all the punching bags 202 suspended from a second horizontal frame member 110*b* adjacent the first horizontal frame member 110*a* are offset in the outward direction, all the punching bags 202 suspended from a third horizontal frame member 110*c* adjacent the first horizontal frame member 110*b* are offset in the inward direction again, and so on for all the horizontal frame members 110. In other words, this pattern is repeated on all the horizontal frame members 110 such that the punching bags 202 are offset alternatingly in the inward direction ID and the outward direction OD from one horizontal frame member 110 to the next.

It will be understood that the above configurations are provided merely as examples, and that many alternative embodiments could be considered. For example, instead of the striking targets 200 being suspended, the target support 101 could instead be adapted to be placed on the ground surface 150 to form a base and the striking targets 200 could include standing punching bags secured to the base so as to extend upwardly and substantially vertically from the base.

It will be appreciated that in the above embodiments, all the participants P are positioned around the frame 102, generally outwardly from the frame 102, and face towards the center of the central space 108 where the instructor I is located during a striking training group session. This allows each participant P to have a clear, uninterrupted line of sight S to the instructor I on either side of their punching bag 202. In some embodiments, the punching bags 202 could even be relatively low or short to allow participants P to have visual access to the instructor I above the punching bag 202.

In another embodiment, at least some participants may be located in an outer rim region of the central space 108, adjacent a corresponding punching bag 202, such that they face away from the instructor I located in the center of the central space 108 either during the entire striking training group session or during one or more portions of the striking training group session. In this embodiment, the participants could still easily obtain a clear, uninterrupted line of sight to the instructor I by simply turning their heads or their entire body so as to face towards the instructor I. Even in this embodiment, the configurations described above allows the participants located in the outer rim region of the central space 108 to have a clear, uninterrupted line of sight to the instructor I which is not blocked by a punching bag or another participant.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A physical training apparatus for use in striking training, the apparatus comprising:

a frame having a perimeter member extending substantially along a perimeter member plane and a support assembly for supporting the perimeter member above a ground surface such that the perimeter member plane is substantially horizontal, the perimeter member surrounding a central space for receiving an instructor; and a plurality of striking targets suspended from the perimeter member, the striking targets being positioned around the central space to allow a user positioned radially outwardly from the frame, adjacent one of the striking targets and facing inwardly towards the central space, to interact with the striking target while maintaining visual contact with the instructor when the instructor is positioned in the central space, wherein the perimeter member forms a closed loop and includes a plurality of horizontal frame members connected end-to-end to each other, wherein each striking target is offset laterally relative to a longitudinal axis of a corresponding horizontal frame member, and wherein each striking target is supported by a support bracket extending laterally away from the corresponding horizontal frame member.

2. The apparatus as claimed in claim 1, wherein the support bracket includes a cantilevered beam member extending horizontally between a proximal end secured to the support bracket and a distal end configured for holding the striking target.

3. The apparatus as claimed in claim 2, wherein the support bracket further includes an eye bolt extending downwardly from the distal end of the cantilevered beam member for attaching a link member extending upwardly from the striking target.

4. The apparatus as claimed in claim 2, wherein the cantilevered beam member is perpendicular to the corresponding horizontal frame member.

5. The apparatus as claimed in claim 2, wherein the support bracket further includes:

a bracket bar spaced downwardly from the corresponding horizontal frame member and extending parallel thereto; and a diagonal brace member having a lower end secured to the bracket bar and an upper end secured to the distal end of the cantilevered beam member.

6. The apparatus as claimed in claim 1, wherein all the striking targets suspended from a same horizontal frame member are offset from the horizontal frame member in one of an inward direction towards the central space and an outward direction away from the central space.

7. The apparatus as claimed in claim 6, wherein all the striking targets suspended from a first horizontal frame member are offset in one of the inward and outward directions and all the striking targets suspended from a second horizontal frame member adjacent the first horizontal frame member are offset in the other one of the inward and outward directions such that the striking targets are offset alternatingly in the inward direction and the outward direction between adjacent horizontal frame members.

8. The apparatus as claimed in claim 1, wherein each striking target includes a punching bag.

9. The apparatus as claimed in claim 1, wherein all the horizontal frame members have a same length.

10. The apparatus as claimed in claim 1, wherein the plurality of striking targets includes a plurality of pairs of striking targets, each pair of striking targets being suspended from a corresponding horizontal frame member.

11. The apparatus as claimed in claim 1, wherein the plurality of horizontal frame members includes eight horizontal frame members defining an octagonal loop.

12. The apparatus as claimed in claim 1, wherein the plurality of horizontal frame members includes four horizontal frame members defining a square loop.

13. The apparatus as claimed in claim 1, wherein the support assembly includes a plurality of vertical posts having a lower end for resting on a ground surface and an upper end secured to the perimeter member.

14. The apparatus as claimed in claim 1, wherein the support assembly includes a plurality of suspension members extending downwardly from a ceiling surface, each suspension member having an upper end secured to the ceiling surface and a lower end secured to the perimeter member.

15. The apparatus as claimed in claim 1, wherein each striking target is further tethered to the ground surface below the striking target.

16. A method for using a physical training apparatus for striking training, the method comprising:

providing a training apparatus including:

a frame having a perimeter member and a support assembly for supporting the perimeter member above a ground surface, the perimeter member surrounding a central space adapted to receive an instructor, the perimeter member forming a closed loop and including a plurality of horizontal frame members connected end-to-end to each other; and a plurality of striking targets suspended from the perimeter member, each striking target being offset laterally relative to a longitudinal axis of a corresponding horizontal frame member, each striking target being supported by a support bracket extending laterally away from the corresponding horizontal frame member;

positioning an instructor in the central space; and positioning a plurality of users around the frame, radially outwardly from the central space, each user being positioned adjacent one of the striking targets and facing inwardly towards the central space to allow the user to interact with the striking target while maintaining visual contact with the instructor.

* * * * *